US006245390B1

(12) United States Patent
Baranovski et al.

(10) Patent No.: US 6,245,390 B1
(45) Date of Patent: Jun. 12, 2001

(54) HIGH-VELOCITY THERMAL SPRAY APPARATUS AND METHOD OF FORMING MATERIALS

(76) Inventors: Viatcheslav Baranovski, 12700 Stonebriar Ln., Richmond, VA (US) 23233; Andrew Verstak, 2704 Waterford Way ID, Midlothian, VA (US) 23112

( * ) Notice: Subject to any disclaimer, the term of this patent is extended or adjusted under 35 U.S.C. 154(b) by 0 days.

(21) Appl. No.: 09/393,575

(22) Filed: Sep. 10, 1999

(51) Int. Cl.[7] ..... C23C 4/12; B05B 1/24

(52) U.S. Cl. ..... 427/449; 427/446; 239/79; 239/83; 219/76.14; 219/76.15; 219/76.16

(58) Field of Search ..... 427/446, 449; 239/79, 83; 219/76.14, 76.15, 76.16

(56) References Cited

U.S. PATENT DOCUMENTS 4,909,914 * 3/1990 Chiba et al. ..... 204/164
5,271,965 * 12/1993 Browning ..... 427/446
5,932,293 * 8/1999 Belashchenko et al. ..... 427/446
6,003,788 * 12/1999 Sedov ..... 239/79

* cited by examiner

*Primary Examiner*—Katherine A. Bareford

(57) ABSTRACT

The high-velocity oxygen-fuel or air-fuel apparatus and method to apply low-oxidized and high-density coatings and bulk materials by spraying of non-fused particles, said apparatus comprises a catalytic member in internal burner. Metallic or ceramic catalyst of the catalytic member allows stable combustion at gas temperatures below the melting point of spraying material. Lowering of combustion temperature occurs when increasing the pressure and flow rate of the oxidizer or fuel over stoichiometrical or when adding an inert gas into combustible mixture. The catalytic member contains a catalyst selected from the group of noble metals, or binary oxides of the noble metal and rare earth metal, or other high temperature resistant catalyst capable to lower an ignition temperature of the oxidizer and fuel mixture. The catalytic member is made in a form of a wire or wire-net insert, or a coating on walls and passages of the internal burner or a coating on at least one catalyst ceramic support placed in the internal burner.

9 Claims, 3 Drawing Sheets

HIGH-VELOCITY THERMAL SPRAY APPARATUS AND METHOD OF FORMING MATERIALS

BACKGROUND OF THE INVENTION

The present invention relates generally to flame spray apparatus and to methods of deposition of coatings and bulk materials with thermal spraying technique. More specifically, the present invention relates to high-velocity oxidizer-fuel spraying apparatus and methods. When the oxidizer gas is oxygen, the technique is known as High-Velocity Oxygen-Fuel (HVOF) spraying. Correspondingly, when the oxidizer gas is air or air enriched with oxygen, the technique is known as High-Velocity Air-Fuel (HVAF) spraying.

Thermal spraying is widely used to apply metals and ceramics in a form of coatings or bulk materials on different type of substrates. Majority of thermal spray methods utilizes the energy of hot gaseous jets to heat and accelerate particles of spraying material. When impinging the substrate, the particles form a coating.

Typically, the High-Velocity Oxygen-Fuel (HVOF) apparatus generates a jet of hot gases due to combustion of a fuel and oxygen in internal burner at elevated pressure, usually several bars. The fuel can be gaseous such as propane, methane, propylene, MAPP-gas, hydrogen etc., or liquefied such as kerosene. From the burner the gas expands into an exhaust nozzle or barrel, reaching sonic velocity. Further expansion in atmosphere or into wider section of the nozzle (for instance, Laval's nozzle) results in formation of a supersonic velocity jet. For this reason the technique is named "high-velocity". The first such apparatus was invented by James A. Browning (U.S. Pat. Nos. 4,342,551 and 4,343,605, both issued August, 1982). A number of improvements for the HVOF guns was targeting their better efficiency to heat and accelerate spraying material (U.S. Pat. Nos. 4,370,538; 4,416,421; 4,540,121; 4,568,019; 4,634,611; 4,836,447; 5,019,686; 5,206,059; 5,535,590). In spite of formation of rather dense coatings, the HVOF processes deposit materials with rather high oxide content, as they melt the particles, at least partially, thus making the particle surface very active. As the jets always contain gaseous oxygen due to incomplete combustion and ejection of air from the atmosphere, the particle molten surface oxidizes rapidly. Besides, these processes are rather expansive due to large consumption of compressed oxygen. Finally, clogging of the long nozzle by molten spraying particles creates a lot of problems in operation of the HVOF devices.

The High-Velocity Air-Fuel (HVAF) equipment first was created as a cheaper alternative to the HVOF process (U.S. Pat. No. 5,120,582). The combustion of air and kerosene is the main mode of such equipment operation. The design was further improved in the U.S. Pat. Nos. 5,405,085 and 5,520,334. The main problem of such equipment is unstable combustion at high flow rates of gases as the flame propagation velocity in the fuel-air mixture is two orders of magnitude lower than in the fuel-oxygen mixture. Rather dimensional internal burners are used to stabilize and complete combustion. But this prevents a possibility to introduce spraying powder in the axis of the chamber and nozzle (the chamber is too long for the particles to travel through). The injection of particles into the nozzle side (the alternative to axis injection) creates even bigger problems with the nozzle clogging than in the HVOF equipment utilizing axis injection. The use of hydrogen or methane to ignite the combustion and as a pilot flame in many HVAF guns makes them unpractical and unsafe.

Vladimir Belashchenko and Viatcheslav Baranovski, one of the authors of the present invention did an important improvement in the HVAF design (U.S. Pat. No. 5,932,293). A permeable burner block was introduced into the internal combustion chamber. When heated over the auto-ignition temperature of air-fuel mixture, hot walls and passages of the permeable burner block continuously ignite the mixture, thus stabilizing combustion in rather small-size burner. However, the combustion is stable only in narrow range of air-to-fuel ratio (close to stoichiometrical one) and total gas flow is restricted as it cools the permeable burner block. This significantly restricts variations in technological parameters necessary for spraying of different materials, as well creates technical problems when droplets of liquefied fuel come to the burner (always happens when using propane and heavier fuels). The droplets of fuel evaporate in the burner dramatically decreasing the air-fuel ratio and destabilizing combustion.

Still, the HVAF coatings are rather oxidized, as the combustion temperature (1900 degrees C. for propane-air mixture and higher for heavier fuels) exceeds the melting temperature of majority of spraying materials, thus at least the surface of spraying particles is molten and actively oxidized by oxygen in a jet.

Meanwhile, it becomes clear that the oxidation of materials during spraying can be substantially suppressed when spraying solid, non-fused particles. Anatoley Alkimov and co-authors patented a gas-dynamic spraying method for applying a coating (U.S. Pat. No. 5,302,414). In the method, a supersonic jet is created by expanding of compressed gases having a temperature considerably lower than the fusing temperature of the spraying material. The coating is formed during the impact of solid particles, which are not heated and thus practically not oxidized during deposition. However, the coatings formed of non-heated particles are rather porous compared to the HVOF coatings. The attempts to pre-heat the compressed gas with electrical heaters have little effect on coating quality while making the equipment bulky.

The use of the HVOF and HVAF technique seems to be more promising as the particles can be both accelerated and heated below the melting point of spraying material. James Browning expressed this opinion in U.S. Pat. No. 5,271,965 as well as in Technical Note, published in the Journal of Thermal Spray Technology, 1(4) December 1992, p.289. He assumed that solid particles did undergo fusion during impact with a substrate due to a release of kinetic energy ("impact fusion"). Thus, the particle velocity becomes a key factor of coating formation. The problem is that in known HVOF and HVAF apparatus the reduction of gas temperature in the burner is always accompanied with the decrease of gas velocity. This results in drop of the particle velocity. Rather unusual solutions were found to overcome this problem. For instance, to ensure the particles are in solid state during spraying, J. Browning suggested to cool the jet in the nozzle below the material melting point by injected droplets of water (U.S. Pat. No. 5,330,798). Then, the combustion process itself is not affected. An evident disadvantage of this equipment is a drop of efficiency of the apparatus, as well complication of the process.

Not only the drop of gas velocity with decrease of temperature creates a problem for a good quality coating deposition by spraying of solid particles with the HVOF and HVAF technique. Practically, the necessary drop of gas temperature is impossible to implement in known apparatus without destabilizing the combustion. As known, a stable combustion of oxidizer-fuel mixture at high gas flow is provided in a rather narrow range of oxidizer-to-fuel ratio in the vicinity of stoichiometrical one. The maximal temperature of combustion is reached in this range. For instance, for oxygen-propane mixture the stoichiometrical ratio is about 5:1 by volume and maximal combustion temperature exceeds 2800 degrees C. The excess of oxygen drops the combustion temperature. In case of oxygen-propane, at ratio 2.5:1 the combustion temperature is about 2500 degrees C. Further increase of oxygen content ceases the combustion. In case of air-propane mixture, the stoichiometrical ratio is about 25:1 by volume with maximal combustion temperature about 1900 degrees C. This mixture does not support combustion when the ratio is shifted more than 10% even in presence of "hot" walls of permeable burner block (as in the U.S. Pat. No. 5,932,293). Thus, in the HVAF process, to drop the gas temperature with increase of air or propane content over stoichiometrical is practically impossible. Note that mentioned gas temperatures are well above the melting point of majority of commercial alloys used for thermal spraying. Thus, at least the surface of spraying particles is fused, resulting in rapid oxidation of material during spraying. The use of fine particles, for instance, less than 20 micrometers, aggravates the problem significantly.

BRIEF SUMMARY OF THE INVENTION

The high-velocity oxygen-fuel or air-fuel apparatus and method of this invention is adapted to form low-oxidized and high-density coatings and bulk materials by spraying of non-molten particles with particle velocity approaching the velocity of the gaseous jet. The apparatus comprises an oxidizer-fuel mixing assembly, an internal burner, an ignition device, an expanding nozzle and a spraying material delivery unit. In additional, the apparatus comprises a catalytic member in the internal burner to lower the combustion temperature of the mixture below the melting point of spraying material when increasing the pressure and flow rate of the oxidizer or fuel over stoichiometrical or when adding an inert gas into the mixture.

In the present invention, the catalytic member in the internal burner fulfills at least two main functions. First, it significantly lowers an ignition temperature of the oxidizer-fuel mixture. Because of this, the total flow rate of gases can be increased significantly without a danger of "overcooling" the catalytic surface, which is supposed to ignite the combustible mixture. Secondly, the catalytic member adsorbs reactive gases on the surface of the catalyst providing a reaction (combustion) at practically any concentration of the gases. If the surface of the catalyst is large enough, it is capable to promote combustion at any reasonable oxidizer-to-fuel ratio. Thus, in the presence of the catalyst, it is possible to increase the pressure and flow rate of the oxidizer or fuel over stoichiometrical or to add an additional inert gas (such as nitrogen) to the mixture, thus cooling gases to selected temperature without destabilizing the combustion. On the other hand, for spraying materials with high melting point, a substantial increase of the pressure and flow rate of both oxidizer and fuel is possible when using the catalytic internal burner to increase the total energy of the jet.

An important factor is that the increase of gas pressure and flow rate efficiently compensates the loss of the gas velocity in the nozzle with temperature decrease. Besides, the gas density grows. As a result, the velocity of spraying particles does not drop with temperature decrease. On the contrary, a significant increase of particle velocity occurs as two new factors become available to use: (a) an ability to spray fine particles, such as 1–20 micrometers or smaller, which can be accelerated almost to the velocity of gaseous jet, and (b) an ability to use as long as necessary nozzle to accelerate the particles due to absence of the nozzle clogging by solid particles. In the present invention, the particle velocity is at least 600 m/s–800 m/s when using air-propane combustible mixture.

In the apparatus and method of the present invention, the catalytic member contains a catalyst selected from the group of noble metals such as platinum, palladium and rhodium, or one or more binary oxides of said noble metal and rare earth metal (Ce, La, Nd etc.), or one or more binary oxides formed by barium, strontium and rare earth metal, or other catalyst resistant to high temperature oxidation and capable to lower the ignition temperature of used oxidizer-fuel mixture.

The catalytic member is made in a form of wire or wire-net insert, as a coating on walls and passages of the internal burner components, as a coating on at least one ceramic support (porous, perforated or in the form of powder) placed in the internal burner. The catalytic coating can be applied only on the surfaces where the combustion is desirable, thus localizing combustion in necessary area and protecting other surfaces of the burner against overheating.

The high-velocity thermal spray apparatus may further include at least one additional internal burner having an annular geometry around the first (inner) expanding nozzle and at least one additional expanding nozzle. Such a "cascade" of the burners and nozzles is constructed to further accelerate the particles and provide relatively slow and uniform heating of them below the melting point of spraying material.

The material delivery unit in the present invention may feed either powder or wire into the apparatus. In case of powder stock, the material delivery unit includes at least one injector to deliver the powder particles into the internal burner or/and into the expanding nozzle at selected locations. In preferred embodiment the injection of powder is provided in the axis of the internal burner, thus maximizing heating and accelerating efficiency of the apparatus.

In the case of wire stock, the material delivery unit is a dual-wire electric arc apparatus constructed to deliver molten by an electric arc wire tips in the axis of the internal burner or expanding nozzle. In the preferred embodiment of the apparatus and method, molten wire is atomized into fine particles, accelerated and cooled by the high-velocity gaseous jet formed due to combustion of oxidizer-fuel mixture in excess of fuel. The higher than stoichiometrical flow rate of the fuel is necessary not only to decrease the gas temperature below the melting point of spraying material, but also to create reducing environment in the jet, thus suppressing possible oxidation of the material during spraying. Cooler jet allows applying the coating from shorter standoff distance between the nozzle and the substrate, where the protection against oxidation by not combusted fuel is more efficient (the jet is less diluted with air ejected from atmosphere).

DETAILED DESCRIPTION OF THE INVENTION

The present invention is aimed to create an apparatus and method to apply low-oxidized and high-density coatings and bulk materials by high-velocity thermal spraying of heated but not fused particles with particle velocity approaching the velocity of the gaseous jet.

Figure 1:
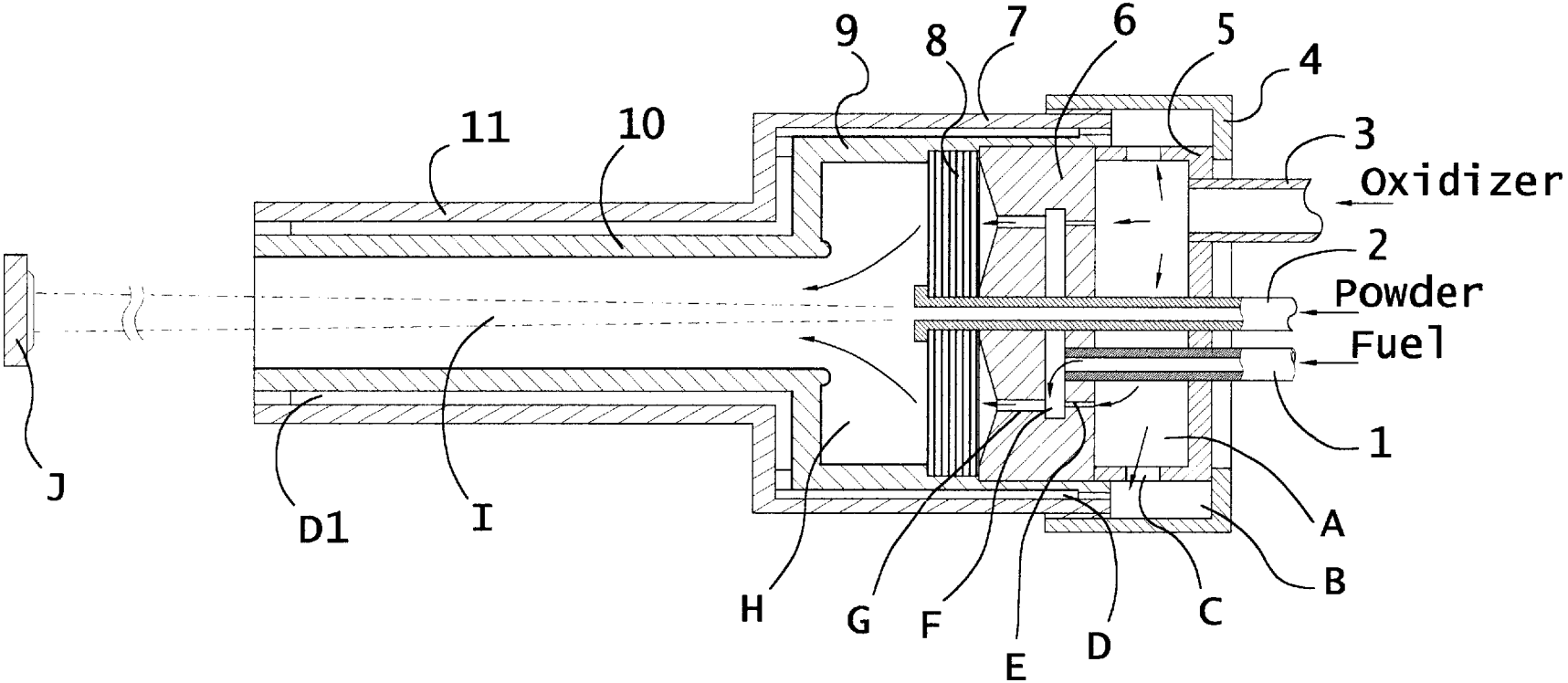
FIG. 1 is a schematic, longitudinal sectional view of high-velocity thermal spray apparatus with catalytic member in a form of a wire-net insert forming internal burner; the injection of spraying material is into the axis of the burner in a form of powder.

An understanding of the present invention may be obtained by reference to FIG. 1, which is a longitudinal sectional view of high-velocity thermal spray apparatus with catalytic member made as a wire-net insert forming internal burner. The apparatus works with air-gaseous fuel mixture. The preferred embodiment of the apparatus comprises a mixing assembly, formed by fuel supply tube 1, air supply tube 3, air distributor 5 and mixing block 6. It also comprises a catalytic burner, formed of catalytic member 8 made as a wire-net insert in chamber H. The downstream part of the chamber H serves as a collector of gaseous products of combustion. Gas collector housing 9 confines it. Finally, the preferred embodiment includes gas expanding nozzle 10 and material delivery unit in a form of powder injector 2. The parts are assembled in cylindrical body consisting of body housing 7, body back housing 4 and nozzle housing 11.

In this preferred embodiment, compressed air comes through air supply tube 3 into air distribution chamber A. Part of this air comes through distributor bores C into cooling section B and then into cooling passages D, thus cooling the apparatus. This part of the air flows out of the apparatus through the nozzle cooling passage D1, forming an annular stream around main gas jet. The other part of air flows from the air distribution chamber A into mixing chamber F through air bores E in the mixing block 6. Gaseous fuel, such as propane or propylene, is supplied with the fuel supply tube 1 into the mixing chamber F. Because of expansion of compressed air from the small size air bores E into the large mixing chamber F, air ejects the fuel forming an air-fuel mixture. Through mixture outlet bores G in the mixing block 6 the mixture flows into the part of chamber H with the catalytic member 8. This part of the chamber H fulfils the functions of combustion chamber. The mixture is ignited with spark plug or glowing device (not shown) inside the catalytic member 8 and combusts on the surface of a catalyst. Gaseous combustion products expand into the nozzle 10 forming a high-velocity jet. The jet reaches supersonic velocity when expanding from the nozzle 10 into an atmosphere. The particles of spraying material are delivered into the axis of chamber H through the powder injector 2 by a carrier gas such as compressed nitrogen. Flying through the chamber H and nozzle 10, the particles are heated and accelerated by the gaseous jet of combustion products forming an energized stream of particles 1. When impacting the substrate J, the particles form a coating or bulk material.

In the present invention, the catalytic member in the internal burner fulfills at least two main functions. First, it significantly lowers the ignition temperature of the oxidizer-fuel mixture. The mechanism is based on lowering the activation energy of a reaction between oxygen and fuel molecular by involving them into reversible oxidation-reduction reactions on the surface of the catalyst. Then, the total flow rate of gases can be increased significantly without a danger of "overcooling" of the catalytic surface, which is supposed to ignite the combustible mixture. Secondly, the catalytic member adsorbs reactive gases on the surface of the catalyst providing a reaction (combustion) at practically any concentration of these gases. As the surface of the catalyst is very large, it is capable to promote combustion at any reasonable oxidizer-to-fuel ratio. As a result, in the presence of the catalyst, it is possible to increase the pressure and flow rate of oxidizer or fuel over stoichiometrical or to add an additional inert gas (such as nitrogen) to the mixture, thus cooling gases to selected temperature without destabilizing the combustion. In particular, for the same combustion chamber size the air flow is possible to increase from 10–12 cubic meters per minute (in absence of catalyst) to 20–25 cubic meters per minute (with catalytic member) without disrupting the combustion, thus lowering the jet temperature from 1900 degrees C. down to 1000–1200 degrees C. Of cause, it is also possible to increase the pressure and flow rate of both oxidizer and fuel through the catalytic burner, thus increasing total energy of the jet. This is useful for spraying of materials with high melting point, such as refractory metals or titanium alloys.

The increase of gas pressure and flow rate efficiently compensates the loss of the gas velocity in the nozzle with temperature decrease. Besides, the gas density grows. As a result, the velocity of spraying particles does not drop with temperature decrease. On the contrary, a significant increase of particle velocity occurs as two new factors become available to use. The first one is an ability to spray fine particles of powdered materials, such as 1–20 micrometers or lower, which can be accelerated to the velocity of the gaseous jet. The second is an application of the nozzles of any necessary for particle acceleration length due to absence of the nozzle clogging by solid particles.

In the described preferred embodiment, the catalytic member may contain a catalyst selected from the group of noble metals such as platinum, palladium and rhodium, or one or more binary oxides of said noble metal and rare earth metal (Ce, La, Nd etc.), or one or more binary oxides formed by barium, strontium and rare earth metal, or other catalyst resistant to high temperature oxidation and capable to lower the ignition temperature of used oxidizer-fuel mixture.

The catalytic member can be made not only in a form of wire-net insert, but also as a coating on walls and passages of the internal burner or as a coating on at least one ceramic support (porous, perforated, in a form of powder etc.) placed in the internal burner instead of the wire-net insert. The catalytic coating can be applied only on the surfaces where the combustion is desirable, thus localizing combustion in necessary area and protecting other surfaces of the burner against overheating.

Figure 2:
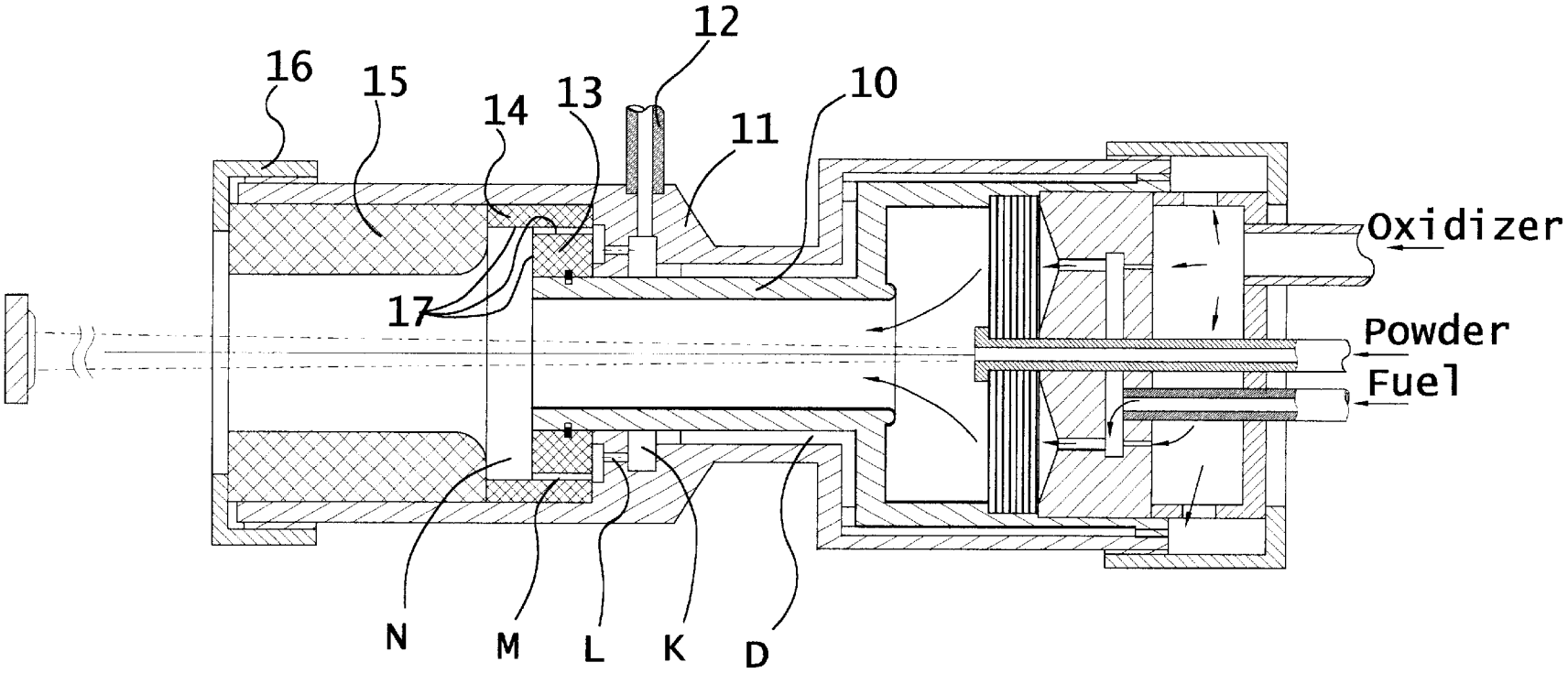
FIG. 2 is a schematic, longitudinal sectional view of high-velocity thermal spray apparatus with catalytic member in a form of wire-net insert; the apparatus comprises an additional catalytic burner having an annular geometry around the first (inner) expanding nozzle and one additional (outer) nozzle.

Referring now to FIG. 2 of the drawing, the preferred embodiment of the high-velocity air-fuel apparatus is illustrated, comprising an additional internal burner having an annular geometry around the first (inner) expanding nozzle and one additional nozzle. The primary burner and nozzle work as described above. Additional chamber N is located between the outlet of inner expanding nozzle 10 and nozzle housing 11. In the chamber N, the secondary burner is confined by inner catalyst support ring 13, made of SiC—Al203 ceramic, and outer catalyst support ring 14, made of Al203-base ceramic. The outer cylindrical surface of the inner ring 13 and its downstream side surface, as well as the inner cylindrical surface of the outer ring 14 are covered with the catalytic coating 17, such as platinum or platinum-cerium oxide. Secondary expanding nozzle 15 is made of SiC-ceramic. It is fixed in the nozzle housing 11 with nozzle nut 16. Fuel for the secondary burner is supplied with secondary fuel supply tube 12. It is mixed in secondary chamber K with cooling air coming from the cooling passages D. The mixture flows through secondary mixture outlet bores L into the secondary burner in a form of slot M confined by catalytic surfaces of the inner catalyst support ring 13 and the outer catalyst support ring 14. The mixture is ignited from the back-flash of primary gas jet expanding from the inner nozzle 10. The combustion products expand into the secondary nozzle 15 where they are mixed with the primary jet carrying the stream of particles. Such scheme provides very "soft" and uniform heating of spraying particles. It also has a great effect on the particle acceleration. In this preferred embodiment, the particle velocity exceeds 600 m/s. In particular, for the length of the secondary nozzle 200 mm and 10 □m average particle size of alloy 625 powder, the average particle velocity reaches 800 m/s when using air-propane combustible mixture.

Figure 3:
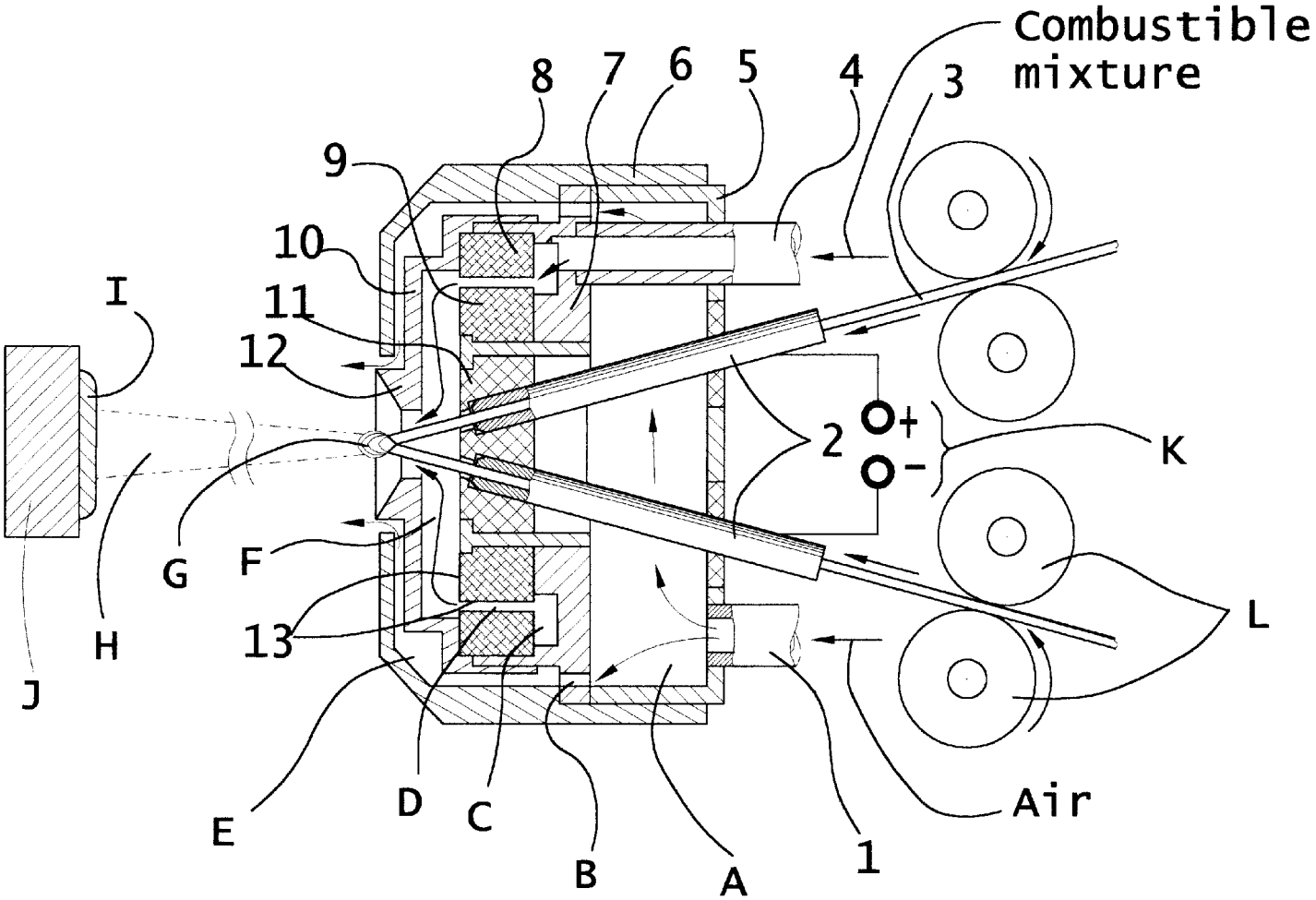
FIG. 3 is a schematic, longitudinal sectional view of high-velocity thermal spray apparatus with catalytic member in a form of a coating onto passages and downstream surface of catalyst ceramic support forming the internal burner; the injection of spraying material is into the expanding nozzle axis in a form of two consumable wire tips molten by an electric arc machine.

Another preferred embodiment is presented in FIG. 3, which is a schematic, longitudinal sectional view of high-velocity thermal spray apparatus with catalytic member in a form of a coating onto passages and downstream surface of a catalyst ceramic support in the internal burner while the injection of spraying material is into the expanding nozzle axis in a form of two consumable wire tips molten by an electric arc machine. The apparatus comprises a body 7, holding inner catalytic support ring 9, made of SiC—Al203 ceramic, and outer catalytic support ring 8, made of Al203-base ceramic. The burner is in a form of combustion slot D created between these two rings. Forming the slot D cylindrical surfaces of the rings and the downstream surface of the inner ring 9 are covered with catalytic coating 13, made of barium and lanthanum oxides or metallic platinum. Body back housing 5 is attached to the body 7, holding cooling air supply tube 1, combustible mixture supply tube 4 and two contact tubes 2 directing two spraying wires 3 in the axis of expanding nozzle 12. The position of the contact tube 2 is adjusted by positioner 11 placed in the body 7. Collector housing 10 is attached to the front of the body 7. Its outlet is made in a form of expanding nozzle 12. The front of the body 7 is covered with air cap 6. The combustible mixture, for instance, air-propane mixture is supplied with the tube 4 into ring-shaped mixture distribution chamber C in the body 7. Then the mixture flows through the combustion slot D, where it combusts onto the surface of the catalytic coating 13. To start combustion, a spark plug igniter is used (not shown in FIG. 3). Non-reacted gases, if any, combust on the downstream surface of the inner ring 9, covered with the catalytic coating. The gaseous products of combustion are directed into collector chamber F by the collector housing 10 and then into the expanding nozzle 12. Expanding from the nozzle 12, the gaseous jet reaches supersonic velocity. Two consumable wires 3 for spraying are fed by wire feeding mechanism L through the contact tubes 2 into the nozzle 12 axis. An electric arc G, supported by electric power supply K of arc machine, melts the wire tips in the nozzle 12. The gaseous jet of combustion products atomizes the molten wire tips into the fine particles and accelerates them, forming energized particle stream H. When impacting the substrate J, the particles form the coating 1. The combustion in the slot D is provided in excess of fuel over stoichiometrical to reach two goals: (a) to cool down the gaseous jet of combustion products below the melting point of spraying material thus allowing efficient cooling of atomized particles and (b) to protect spraying particles against oxidation in the jet. In particular, for the air-propane mixture, the use of the catalytic support member allows to increase the flow rate of propane 3–4 folds over stoichiometrical without ceasing the combustion. A cooling air is supplied into the air distribution chamber A with the tube 1. Through the cooling bores B in the body 7 the cooling air flows into cooling passage E between the air cap 6 and the collector housing 10 and leaves the apparatus around the nozzle 12, forming annular stream. This stream envelops the high-velocity jet of gases suppressing an ejection of oxygen from the atmosphere.

EXAMPLE

A coating of alloy 671-type powder (Ni-base —43%Cr —0.5%Ti—0.9%Si), particle size 10–45 micrometers, was sprayed with apparatus, comprising two internal burners and two nozzles (as described in preferred embodiment in FIG. 2). A catalytic member was made in a form of porous catalyst support ring made of Al203-12%SiO2 ceramic, 64% total porosity, with platinum catalytic coating. The apparatus operated with air flow 20 cubic meters per minute, inlet pressure 8.4 bar, and propane flow 2 kilograms per minute, pressure 5 bar. Total air flow was increased 70% over stoichiometrical, lowering the exhaust gas temperature to approximately 1400 degrees C. The coating of 0.4 mm thickness was deposited on type 1018 carbon steel substrates made as samples for bond strength measurement (according to ASTM C633 standard) and 75×25×6 mm coupons for coating structure investigations, as well as on porous stainless steel (type 316SS) filter-samples, 25 mm diameter, 6 mm thickness, pore size 2 micrometers, to measure coating gas permeability (according to ISO 4022 standard). Apparent oxide content and porosity in the coating was measured on the coupon cross-section with metallographic image analysis method. Total oxygen content in the coating was measured with the method of reducing fusion in inert carrier gas flow (LECO Oxygen Analyzer). Total oxygen content in the powder stock material was 0.06%.

The following characteristics of the coating were obtained:

| | |
|---|---|
| (1) apparent porosity, % | not measurable |
| (2) apparent oxide content, % | not measurable |
| (3) total oxygen content, % | 0.16 |
| (4) gas permeability coefficient, square nanometers | not measurable (less than 0.01) |
| (5) bond strength, MPa | over 80.0 (rupture through epoxy glue) |

For comparison, when spraying the above material with known HVOF and HVAF technique, oxygen content in the coating varied from 1.0 to 3.5%, which is order of magnitude higher than in the present invention. The gas permeability coefficient (adequate to through porosity) in known HVOF and HVAF coatings was measured from 0.05 to 2.0 square nanometers, which is noticeably higher than for present invention. Thus, the coating deposited according to present invention exhibits superior density and substantially lower oxygen content compared to known HVOF and HVAF technique.

Related Prior Art

| | | | |
|---|---|---|---|
| 4,342,551 | Aug., 1982 | Browning | 431/10 |
| 4,343,605 | Aug., 1982 | Browning | 431/8 |
| 4,370,538 | Jan., 1983 | Browning | 219/121 PY |
| 4,416,421 | Nov., 1983 | Browning | 239/79 |
| 4,540,121 | Sep., 1985 | Browning | 239/13 |
| 4,568,019 | Feb., 1986 | Browning | 239/13 |
| 4,604,306 | Aug., 1986 | Browning | 427/423 |
| 4,634,611 | Jan., 1987 | Browning | 427/423 |
| 4,836,447 | Jun., 1989 | Browning | 239/8 |
| 5,019,686 | May, 1991 | Marantz | 219/76.14 |
| 5,120,582 | Jun., 1992 | Browning | 427/423 |
| 5,206,059 | Apr., 1993 | Marantz | 427/449 |
| 5,271,965 | Dec., 1993 | Browning | 427/446 |
| 5,302,414 | Apr., 1994 | Alkimov, et al. | 427/192 |
| 5,330,798 | Jul., 1994 | Browning | 427/446 |
| 5,405,085 | Apr., 1995 | White | 239/13 |
| 5,520,334 | May, 1996 | White | 239/85 |
| 5,531,590 | Jul., 1996 | Browning | 431/8 |
| 5,932,293 | Aug., 1999 | Belashchenko, et al. | |

Other References

J. A. Browning. "Hypervelocity Impact Fusion —A Technical Note".—Journal of Thermal Spray Technology, Volume 1 (4), December 1992, p.p.289–292.

What we claim as our invention is:

1. A method of forming a coating or bulk material by depositing a material onto a substrate with high-velocity thermal spray apparatus, said method comprising the mixing of an oxidizer gas and a fuel in a mixing assembly, ignition and combustion of said oxidizer and fuel mixture in an internal burner, forming a high velocity gaseous jet of combustion products of said mixture in a gas expanding nozzle, introduction of selected spraying material into said jet with material delivery unit to form a stream of particles accelerated and heated by said jet below the melting point of said spraying material;

wherein said method in addition comprises the use of a catalytic member in said internal burner to lower the combustion temperature of said mixture below the melting point of said spraying material when increasing the pressure and flow rate of said oxidizer or said fuel over stoichiometrical or when adding an inert gas into said mixture.

2. The method defined in claim 1, wherein said method includes the introduction of said spraying material into said high-velocity thermal spray apparatus in a form of powder which does not melt in said jet.

3.The method defined in claim 1, wherein said method includes the introduction of said spraying material into said high-velocity thermal spray apparatus in a form of molten by electric arc tips of wire, rod or other elongated member, atomizing, accelerating and cooling of said spraying material by said jet in excess of said fuel in said burner and gas expanding nozzle to suppress possible oxidation during formation of said coating or bulk material.

4. A high-velocity thermal spray apparatus for depositing a material onto a substrate comprising:

a mixing assembly designed to mix an oxidizer gas and a fuel, an internal burner for combustion of said oxidizer and fuel mixture, an ignition device to start combustion of said mixture, a gas expanding nozzle constructed to receive the products of combustion of said mixture and form a high velocity gaseous jet, a material delivery unit constructed to deliver a selected spraying material into said jet to form a stream of particles accelerated and heated by said jet below the melting point of said spraying material;

wherein said apparatus in addition comprises a catalytic member in said internal burner to lower the combustion temperature of said mixture below the melting point of said spraying material when increasing the pressure and flow rate of said oxidizer or said fuel over stoichiometrical or when adding an inert gas into said mixture.

5. The high-velocity thermal spray apparatus of claim 4 wherein said catalytic member contains a catalyst selected from the group consisting of at least one noble metal, or one or more binary oxides of said noble metal and rare earth metal, or one or more binary oxides formed by barium, strontium and rare earth metal.

6. The high-velocity thermal spray apparatus of claim 4 wherein said catalytic member is made as a wire or wire-net insert, or as a coating on walls and passages of said internal burner where said combustion is desirable, or as a coating on at least one catalyst ceramic support placed in said internal burner.

7. The high-velocity thermal spray apparatus of claim 4 further comprising at least one additional internal burner having an annular geometry around said expanding nozzle and at least one additional nozzle constructed to further accelerate said particles and uniformly heat them below the melting point of said spraying material.

8. The high-velocity thermal spray apparatus of claim 4 wherein said material delivery unit includes at least one injector to deliver said particles of said spraying material into said internal burner or into said expanding nozzle at selected locations.

9. The high-velocity thermal spray apparatus of claim 4 wherein said material delivery unit is a dual-wire electric arc apparatus constructed to deliver molten by an electric arc wire tips in the axis of said internal burner or said expanding nozzle.

* * * * *